US005636528A

United States Patent [19]

Sasaki

[11] Patent Number: 5,636,528

[45] Date of Patent: Jun. 10, 1997

[54] COOLING METHOD AND SYSTEM THEREFOR

[75] Inventor: Makoto Sasaki, Toyota, Japan

[73] Assignee: Hoshizaki Denki Kabushiki Kaisha, Aichi, Japan

[21] Appl. No.: 309,938

[22] Filed: Sep. 21, 1994

[30] Foreign Application Priority Data

Sep. 21, 1993 [JP] Japan ..... 5-257717

[51] Int. Cl.[6] ..... F25B 39/04

[52] U.S. Cl. ..... 62/506; 62/507

[58] Field of Search ..... 62/181, 183, 506, 62/507, 184

[56] References Cited

U.S. PATENT DOCUMENTS

| | | | |
|---|---|---|---|
| 2,516,093 | 7/1950 | Ruff | 62/506 X |
| 3,087,312 | 4/1963 | White | 62/507 X |
| 3,481,152 | 12/1969 | Seeley | 62/183 X |
| 3,926,008 | 12/1975 | Webber | 62/506 X |
| 4,516,407 | 5/1985 | Watabe | 62/506 X |
| 4,680,941 | 7/1987 | Richardson et al. | 62/184 |
| 4,918,943 | 4/1990 | Faust | 62/506 X |
| 5,117,652 | 6/1992 | Takeuchi et al. | 62/506 X |

*Primary Examiner*—William E. Tapolcai
*Attorney, Agent, or Firm*—Koda and Androlia

[57] ABSTRACT

Disclosed is a cooling method and a system therefor. The cooling system is provided with a refrigerant circuit, comprising a small-capacity primary air-cooled condenser to which a vaporized refrigerant compressed in a compressor is supplied; a water-cooled condenser to which the refrigerant fed from said primary air-cooled condenser is supplied; a small-capacity secondary air-cooled condenser to which the refrigerant fed from said water-cooled condenser is supplied; an expansion means to which the liquefied refrigerant fed from said secondary air-cooled condenser is supplied; and an evaporator to which the refrigerant after an abrupt pressure reduction by said expansion means is supplied. According to the cooling system of the invention, consumption of the cooling water in the water-cooled condenser can greatly be reduced, and the running cost of the system can also easily be reduced.

8 Claims, 4 Drawing Sheets

COOLING METHOD AND SYSTEM THEREFOR

BACKGROUND OF THE INVENTION

1. Field of the Invention

This invention relates to a cooling method and a system therefor, more particularly to a method of suitably operating a cooling system including freezers, coolers and refrigerators, each provided with an air-cooled condenser and a water-cooled condenser and also to a system for suitably embodying the method, 2. Description of the Related Art (First Background of the Invention)

In a refrigerant circuit of a freezer so far known, for example as shown in FIG. 6, a refrigerant is designed to repeat the following circulation cycle: a vaporized refrigerant compressed in a compressor 1 is fed to an air-cooled or water-cooled condenser 2 and condensed thereby; the refrigerant thus liquefied is fed to an expansion valve 3 to undergo volume expansion and then evaporated in an evaporator 4 so as to allow the evaporator 4 to perform a freezing operation or ice making operation; and then the vaporized refrigerant is fed back to the compressor 1. In the case the condenser 2 is of an air-cooled system, if the capacity of the compressor 1 is increased so as to improve freezing performance of the freezer, the capacity of the condenser 2 must be increased concomitantly. Accordingly, the outer dimensions of the freezer are inevitably increased greatly. Since the quantity of heat to be exhausted from the condenser 2 is also increased, the temperature of the kitchen or machinery room is elevated to worsen the working environment, in turn, to lower the cooling capability of the condenser itself, affecting the performance of the freezer. It can also be pointed out that the power consumption increases due to the increase of the load of cooling in the kitchen. Meanwhile, in the case the condenser 2 is of a water-cooled system, there is a problem that the freezing cost increases due to the increased amount of cooling water employed.

In the refrigerant circuit of the freezer shown in FIG. 7, a vaporized refrigerant compressed in a compressor 1 is allowed to pass a water-cooled condenser 5 and an air-cooled condenser 6 successively and condensed thereby, and the downstream circulation system is of the same constitution as the one shown in FIG. 6. In this case, opening and closing of a self water feeding valve 7 for supplying a cooling water to the water-cooled condenser 5 is controlled depending on the temperature or pressure of the liquefied refrigerant flowing out of the air-cooled condenser 6. For example, if the temperature or pressure of the liquefied refrigerant drops below a preset value, the self water feeding valve 7 closes to interrupt feeding of the cooling water to the water-cooled condenser 5. Thus, the cooling water dwelling in the water-cooled condenser 5 is heated to a high temperature by the hot vaporized refrigerant fed from the compressor 1, If the thus heated cooling water is discharged from the water-cooled condenser 5, the drain pipe may be bent by the heat of the hot cooling water, or the adhesive for piping may melt to cause leakage in the drain pipe, bringing about troubles such as damage of the carpet laid on the floor on which the freezer is installed. Meanwhile, it can also be pointed out that the water vapor thus formed is condensed into dew drops around the outlet, which gather and drop in the form of droplets, disadvantageously. These unfavorable phenomena described above are liable to be caused upon temperature rise of the cooling water in the water-cooled condenser 5 to 60° C. or higher, even if the self water feeding valve 7 repeats opening and closing around the preset temperature or pressure level.

Next, in the refrigerant circuit of a freezer shown in FIG. 8, a vaporized refrigerant compressed in a compressor 1 is designed to be condensed by first passing it through an air-cooled condenser 6 and then through a water-cooled condenser 5, and the downstream circulation system is of the same constitution as in FIG. 6. The water-cooled condenser 5 is provided with a similar self water feeding valve 7 to the one shown in FIG. 7. In the thus constituted refrigerant circuit, however, the hot vaporized refrigerant discharged from the compressor 1 is all passed through the air-cooled condenser 6 to allow heat dissipation to occur therein as much as possible, irrespective of the level of the ambient temperature. Accordingly, the same inconveniences as in the case of the air-cooled system condenser 2 shown in FIG. 6 can be pointed out. Moreover, since a large amount of cooling water must be supplied to the water-cooled condenser 5, the running cost elevates, disadvantageously.

If the temperature or pressure of the liquefied refrigerant passing through the water-cooled condenser 5 drops below the preset level and the self water feeding valve 7 is closed, the refrigerant is already liquefied at the outlet of the air-cooled condenser 6, resulting in the increase of the downstream piping volume due to the presence of the water-cooled condenser 5. In this case, the amount of the refrigerant to be sealed in the circuit must be increased compared with the case where the vaporized refrigerant is first passed through the water-cooled condenser 5 like in the refrigerant circuit shown in FIG. 7, leading readily to homing etc. when the circulation of the stagnated refrigerant is started and to a liability to damage of the compressor 1, impairing reliability of the freezer, disadvantageously.

The same inconveniences as described above cannot be obviated, if the evaporator 4 is allowed to carry out a defrosting or ice removing operation even in an ice making machine in which a hot gas piping system which passes by the condenser 2 (5,6) and the expansion valve 3 and connects the outlet side of the compressor 1 directly to the inlet side of the evaporator 4 may be provided on each of the refrigerant circuits described above, and the hot gas valve provided on the piping system is let open to introduce the hot vaporized refrigerant fed from the compressor 1 to the evaporator 4.

(Second Background of the Invention)

The cooling system according to the prior art described in Japanese Unexamined Utility Model Publication (Kokai) No. 85-188623 is provided with a dual condenser, and one condenser unit is provided with a refrigerant by-pass, with an electromagnetic valves being disposed on the refrigerant by-pass and to the upstream side of said one condenser unit. In the constitution disclosed therein, these electromagnetic valves are opened and closed alternately, and the dual condenser or only the other condenser unit is operated based on the opening and closing operations of these electromagnetic valves. However, in this constitution, extra equipment including the refrigerant by-pass, switching electromagnetic valves, etc. are required, leading to the cost elevation.

Meanwhile, in the constitution of the prior art cooling system provided with an air-cooled condenser 6 and a water-cooled condenser 5 as described referring to FIGS. 7 and 8, the air-cooled condenser 6 is constantly operated, and the water-cooled condenser 5 is also additionally operated in such cases where the cooling performance is insufficient and the like. Accordingly, if the refrigerator and the like is installed in a small kitchen, the room temperature of the kitchen is elevated due to the heat exhausted from the air-cooled condenser 6 when the ambient temperature is high like in the summer to worsen the working environment in the kitchen. Thus, the cooling load in the kitchen must be increased.

In the above-described prior art cooling system provided with an air-cooled condenser 6 and a water-cooled condenser 5, if the fan motor for the air-cooled condenser 6 breaks down for some reasons or other, the insufficient cooling to be brought about thereby is automatically compensated by the water-cooled condenser 5. Accordingly, if the operation of the refrigerator is continued without the breakdown of the fan motor being noticed, the amount of the cooling water to be consumed in the water-cooled condenser 5 increases extremely, and it is not until the increase of the water consumption is noticed that the breakdown of the fan motor is recognized. Further, if the fan motor for the air-cooled condenser 6 is looked, the electric current continues to flow into the motor to cause overheating thereof, leading to the liability of burning of the motor.

OBJECT OF THE INVENTION

It is an objective of the invention to provide a means which can enhance the cooling capability of the refrigerant condenser in a cooling system and which can minimize the water consumption in the refrigerant condenser and also the quantity of heat to be exhausted into the room.

It is another objective of the invention to provide a means which can securely inhibit the temperature rise of the cooling system provided with an air-cooled condenser and a water-cooled condenser in the room where the cooling system is installed, whereby to reduce the load of cooling in the room.

It is still another objective of the invention to securely detect, referring to a cooling system provided with an air-cooled condenser and a water-cooled condenser, breakdown of the fan motor in the air-cooled condenser, whereby to improve the performance of maintaining the cooling system.

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiments taken in conjunction with the accompanying drawings in which:

DETAILED DESCRIPTION OF THE INVENTION

Figure 6:
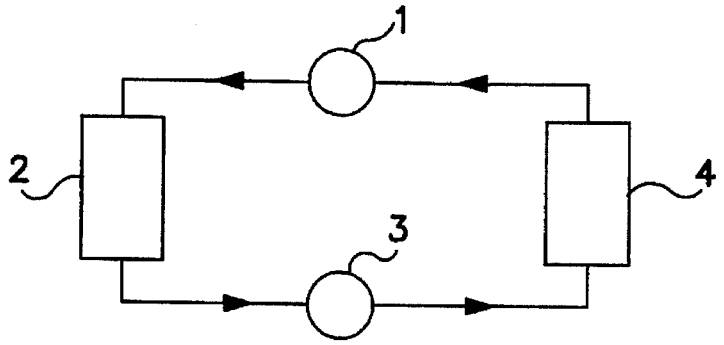
FIG. 6 PRIOR ART
FIG. 6 shows a refrigerant circuit diagram according to a prior art system.
Figure 7:
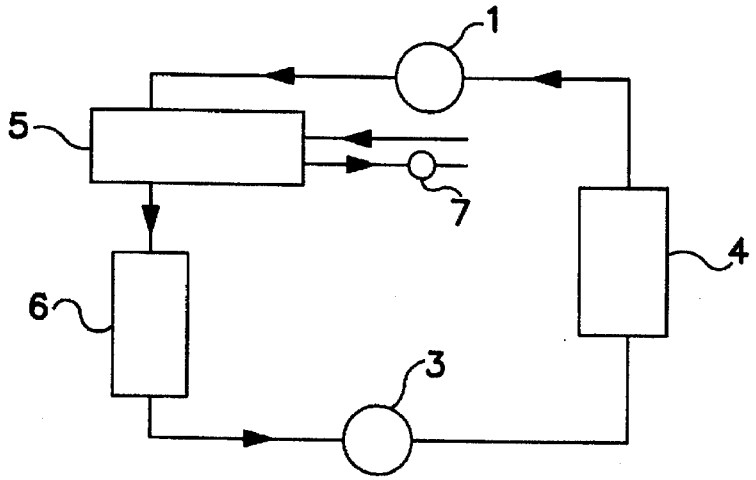
FIG. 7 PRIOR ART
FIG. 7 shows a refrigerant circuit diagram according to another prior art system.
Figure 8:
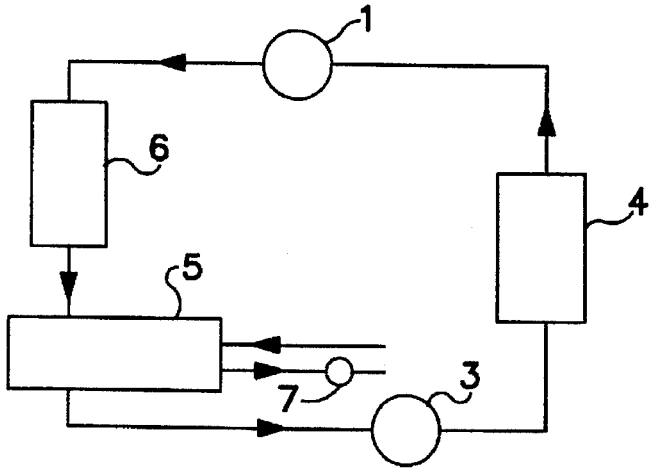
FIG. 8 PRIOR ART
FIG. 8 shows a refrigerant circuit diagram according to another prior art system.

Next, the refrigerant circuit of the cooling system according to this invention will be described by way of preferred embodiments referring to the attached drawings. It should be noted here that the similar members to those described with respect to FIGS. 6 to 8 are affixed with the same reference numbers respectively.

Figure 1:
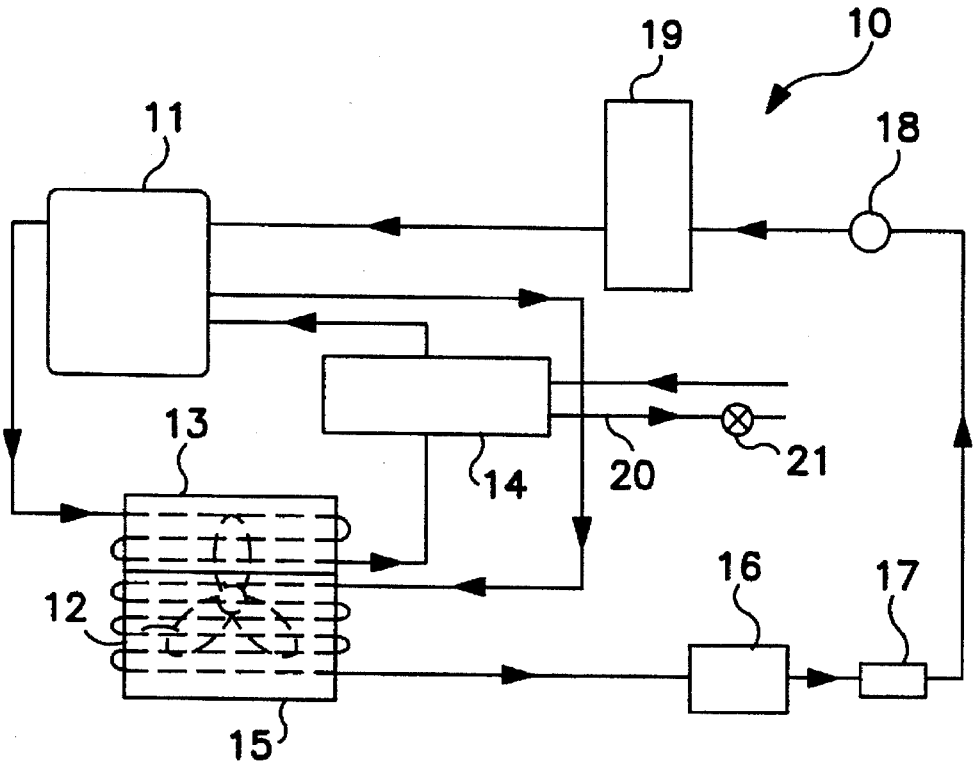
FIG. 1 shows a refrigerant circuit diagram according to a preferred embodiment of the invention.

FIG. 1 shows a refrigerant circuit 10 of an auger type ice making machine, in which a vaporized refrigerant is compressed in a compressor 11 and cooled when it passes through a small-capacity primary air-cooled condenser 13, which is constantly air-cooled by a fan 12, to about 60° C., the saturation temperature of the refrigerant. The thus cooled refrigerant now assuming a form of gas-liquid mixture is introduced to a water-cooled condenser 14. The refrigerant is further allowed to pass successively through an oil cooler (not shown) in the compressor 11 and a secondary air-cooled condenser 15, which is also constantly air-cooled by the fan 12, to be cooled again and condensed.

Subsequently, the thus condensed refrigerant is introduced to a receiver tank 16 to be fully liquefied therein and then passed through a dryer 17, and after the pressure of the refrigerant is abruptly reduced by an expansion valve 18, the thus treated refrigerant is evaporated in an evaporator 19 to deprive heat of a water to be frozen to perform ice making operation, followed by feeding back to the compressor 1. Thus, the refrigerant repeats the above-described circulation cycle. Meanwhile, a self water feeding valve 21 is disposed on a cooling water pipe line 20 connected to the water-cooled condenser 14, and opening and closing of the valve 21 is controlled depending on the temperature or pressure level of the liquefied refrigerant flowing out of the secondary air-cooled condenser 15.

In the refrigerant circuit described above, when the temperature or pressure of the liquefied refrigerant flowing out of the secondary air-cooled condenser 15 is above the preset level, the self water feeding valve 21 opens to supply a cooling water to the water-cooled condenser 14, and thus the refrigerant passing through the water-cooled condenser 14 can adequately be cooled. Accordingly, if the cooling capability of the primary air-cooled condenser 13 and that of the secondary air-cooled condenser 15 are relatively increased due to a drop of the ambient temperature or other reasons to lower the temperature or pressure of the liquefied refrigerant flowing out of the secondary air-cooled condenser 15 below the preset level, the self water feeding valve 21 closes and allows the water-cooled condenser 14 not to perform the operation of cooling the refrigerant.

More specifically, since the self water feeding valve 21 opens to actuate the water-cooled condenser 14 when the ambient temperature is relatively high, the quantity of heat to be exhausted from the primary air-cooled condenser 13 and the secondary air-cooled condenser 15 to the kitchen or machinery room in which the ice making machine is installed can be minimized. Accordingly, the inconvenience that the kitchen or the machinery room is filled with the heat can be prevented, and thus the working environment can be maintained in a good condition, and further the ice making machine can fully exhibit its performance. Thus, the reliability of the ice making machine can easily be enhanced.

On the other hand, since the self water feeding valve 21 closes if the temperature or pressure of the liquefied refrigerant flowing out of the secondary air-cooled condenser 15 drops due to a drop in the ambient temperature and thus it is no more necessary to cool the refrigerant in the water-cooled condenser 14, the consumption of the cooling water can greatly be reduced compared with that in the conventional cooling system, and thus the running cost of the ice making machine can easily be reduced.

Besides, since the refrigerant passing through the water-cooled condenser 14 is already cooled by the primary air-cooled condenser 13 to about 60° C., which is the saturation temperature, even if no cooling water is supplied to the water-cooled condenser 14 and some cooling water dwells therein, it does not happen that the dwelling water is heated to a level higher than the saturation temperature. Accordingly, problems that the vinyl chloride drain pipe is damaged by the heat of the dwelling water discharged from the water-cooled condenser 14 thereto, that water vapor is formed around the discharge port to accelerate formation of dew drops, etc. can be prevented, and thus handling associated with the installation of the ice making machine becomes extremely easy. The similar actions and effects can of course be exhibited even when the self water feeding valve 21 repeats the opening and closing operation depending on the ambient temperature etc.

Further, if the water-cooled condenser 14 is operated under a severe temperature condition, the capacities of the primary air-cooled condenser 13 and the secondary air-cooled condenser 15 can relatively be reduced to reduce the entire volume occupied by the condensers, and thus the ice making machine can be downsized to require smaller installation area therefor. Besides, the water-cooled condenser 14, which is interposed between the primary air-cooled condenser 13 and the secondary air-cooled condenser 15, is designed to be operated as necessary. Thus, since the refrigerant is liquefied at the outlet of the secondary air-cooled condenser 15 disposed on the downstream side of the water-cooled condenser 14, the volume of the piping on the downstream side of the air-cooled condenser 6 can be made smaller compared with that of the downstream piping in the refrigerant circuit shown in FIG. 8. Accordingly, the refrigerant circuit of this invention enjoys an advantage that the amount of the refrigerant to be sealed therein can relatively be small.

It should be noted that, since the primary air-cooled condenser 13 may be of small capacity, forced convection of the cooling air can be omitted by using as the condenser 13 a simple winding copper pipe through which the heat is allowed to radiate. Alternatively, the oil cooler may be omitted, and the refrigerant flowed out of the water-cooled condenser 14 can directly be introduced to the secondary air-cooled condenser 15 like in the refrigerant circuit in FIG. 2. Otherwise, a heat exchange section 22 may be provided by bringing the pipe line connecting the dryer 17 to the expansion valve 18 into contact with the pipe line connecting the evaporator 19 to the compressor 11, so as to allow the refrigerant flowing into the expansion valve 18 from the dryer 17 to be overcooled at the heat exchange section 22. The opening and closing of the self water feeding valve 21 may also be controlled depending on the temperature or pressure of the vaporized refrigerant, having been compressed by the compressor 11, but before condensation by the condenser.

Figure 4:
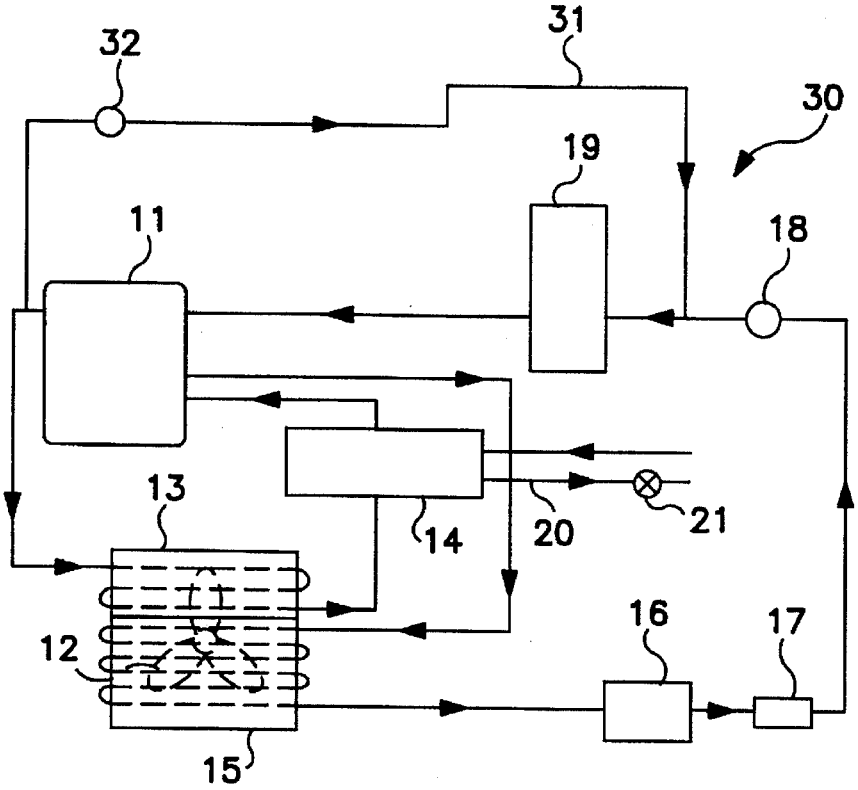
FIG. 4 shows a refrigerant circuit diagram according to a further embodiment of the invention.

FIG. 4 shows a refrigerant circuit 30 of a freezer, which is of the same constitution as the refrigerant circuit 10 shown in FIG. 1 and can exhibit the similar actions and effects as in the refrigerant circuit 10. However, the difference is that a hot gas piping system 31 which communicates the outlet side of the compressor 11 directly to the inlet side of the evaporator 19 is provided, with a hot gas valve 32 being disposed on this piping system 31. When the evaporator 19 is allowed to perform defrosting or removal of ice, it can be achieved by stopping the fan 12, closing the self water feeding valve 21 and opening the hot gas valve 32 so as to allow a hot vaporized refrigerant to be introduced from the compressor 11 to the evaporator 19.

Since the refrigerant circuit 30 is provided with the primary air-cooled condenser 13, the secondary air-cooled condenser 15 and the water-cooled condenser 14, the temperature or pressure, based on which opening and closing of the self water feeding valve 21 is controlled, must be set at a high level compared with the case of a freezer having a refrigerant circuit provided with a water-cooled condenser only. As the result that the pressure of the refrigerant on the high pressure side becomes relatively high during the freezing operation, the initial pressure of the vaporized refrigerant (hot gas) flowing into the evaporator 19 is increased when the freezing operation is interrupted and the hot gas is introduced into the evaporator 19 so as to carry out defrosting or removal of ice thereby. Accordingly, defrosting or removal of ice in the evaporator 19 can be carried out speedily, leading easily to improvement of the freezing performance of the ice making machine.

Further, in the refrigerant circuit 30 provided with the primary air-cooled condenser 13, secondary air-cooled condenser 15 and water-cooled condenser 14, the capacity of the air-cooled condensers may be small compared with the case of the freezing circuit of a freezer of comparable freezing performance provided with an air-cooled condenser only. Accordingly, when the self water feeding valve 21 is closed to interrupt the cooling operation in the water-cooled condenser 14 in the event of low ambient temperature etc. to carry out cooling of the vaporized refrigerant only by the primary air-cooled condenser 13 and secondary air-cooled condenser 15 to perform freezing operation, the pressure of the refrigerant on the high pressure side becomes relatively high. Accordingly, defrosting or removal of ice in the evaporator 19 can be carried out speedily, and thus the freezing performance of the ice making machine can easily be improved.

Figure 2:
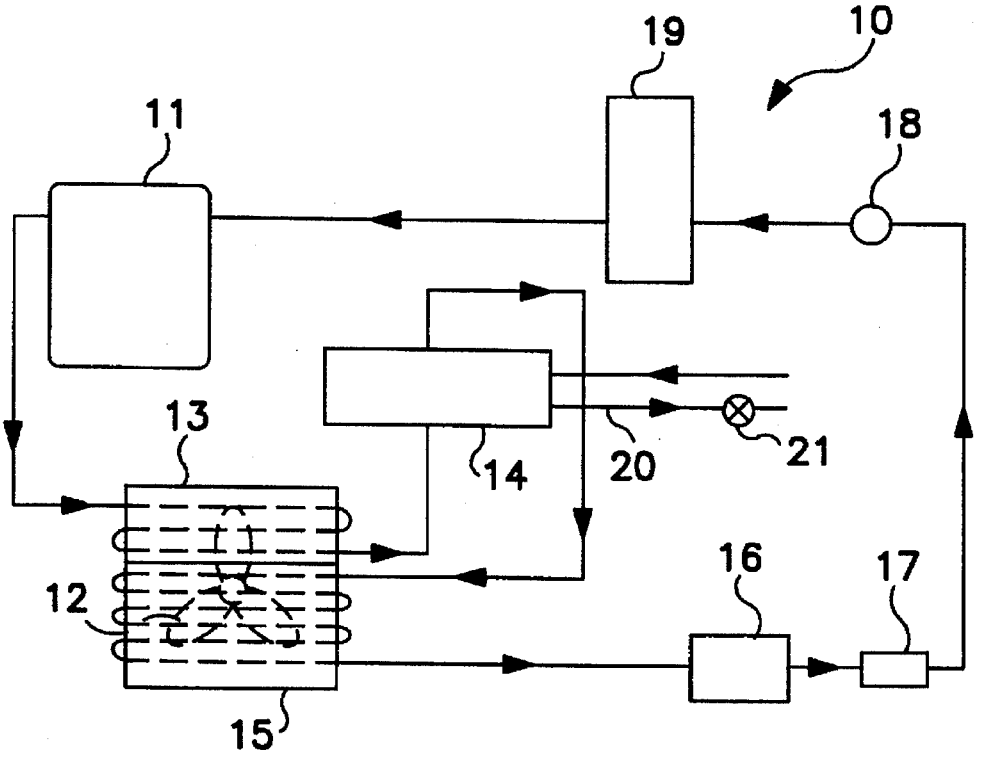
FIG. 2 shows a refrigerant circuit diagram according to another embodiment of the invention.
Figure 3:
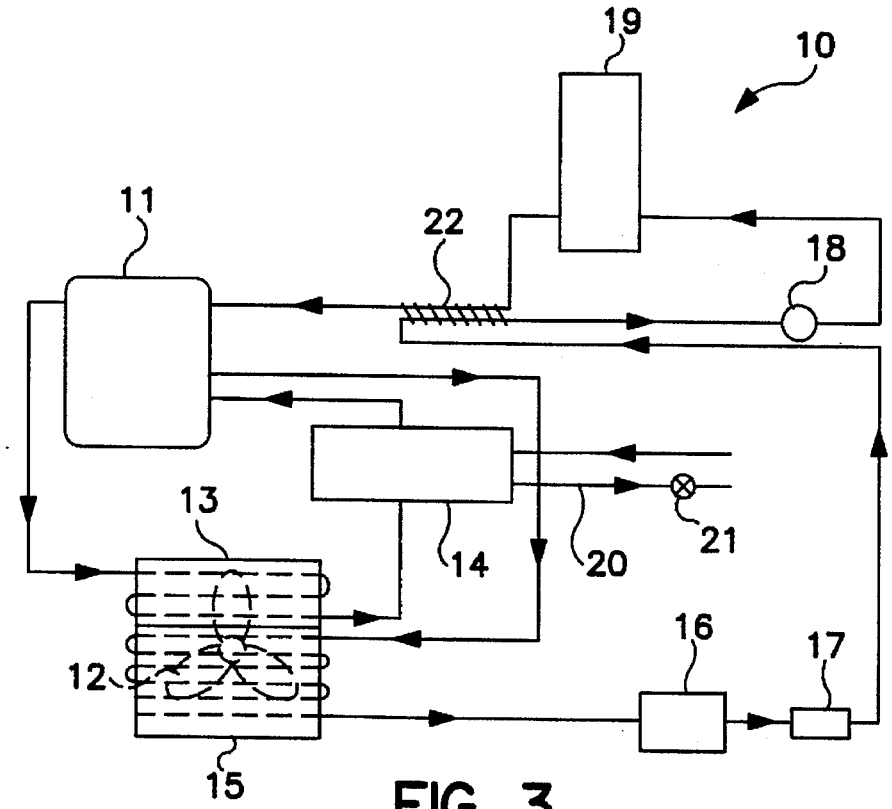
FIG. 3 shows a refrigerant circuit diagram according to still another embodiment of the invention.

It should be noted that the similar actions and effects as in the refrigerant circuit 30 can of course be exhibited by providing a hot gas piping system having a hot gas valve on the refrigerant circuit shown in FIGS. 2 or 3. The freezing capability or water consumption may be changed by replacing the expansion valve employed in each embodiment with a capillary tube and the like, or by changing the preset level of the temperature or pressure for controlling opening and closing of the self water feeding valve. Moreover, this invention can also suitably be embodied in a cooling system such as a cooler, a refrigerator, etc.

Figure 5:
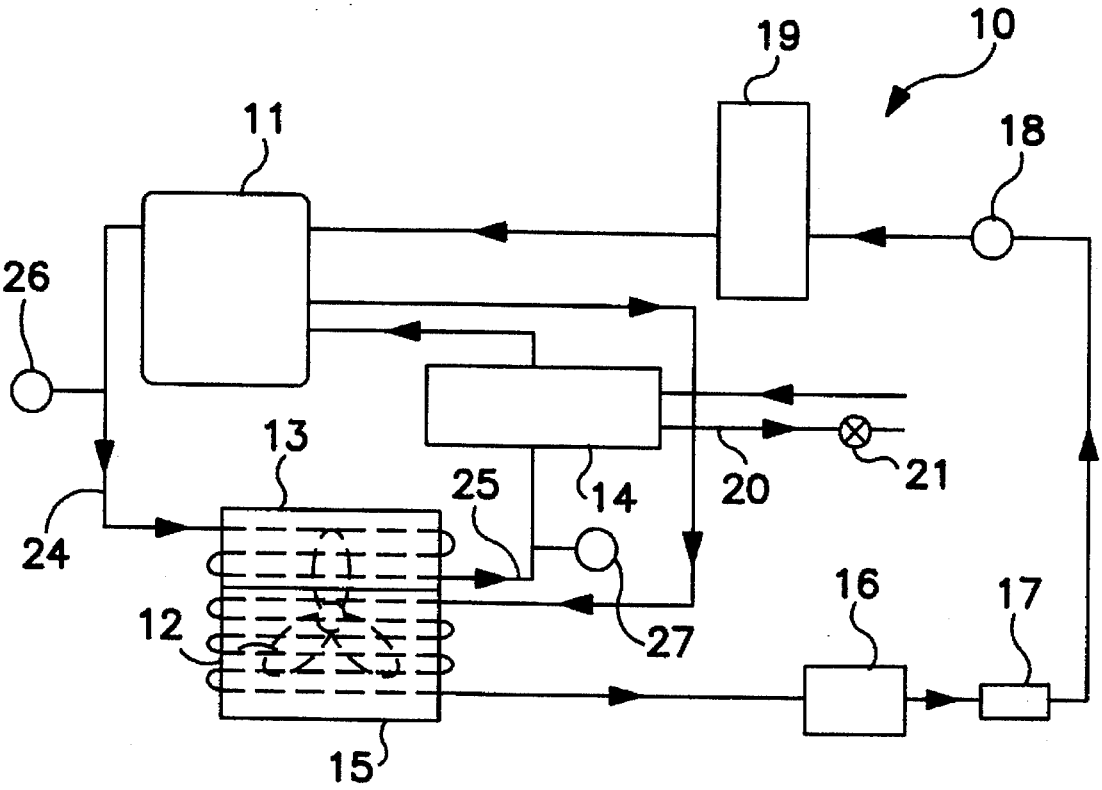
FIG. 5 shows a preferred embodiment of refrigerant circuit diagram according to another aspect of the invention.

Next, FIG. 5 shows a system for embodying the cooling method according to another aspect of the invention, the basic constitution of which is common to the system shown in FIG. 1. What is different from the system of FIG. 1 is that a temperature sensing section 26 or a temperature sensing section 27 consisting of a bimetal system thermostat, a temperature sensing element, etc. is disposed at the corresponding positions of the inlet side refrigerant circuit 24 or the outlet side refrigerant circuit 25 of the primary air-cooled condenser 13.

When the room temperature of the kitchen, the machinery room, etc. in which the ice making machine is installed is relatively high like in the summer, the temperature of the inlet side refrigerant circuit 24 or the outlet side refrigerant circuit 25 of the primary air-cooled condenser 13 is elevated, and such temperature rise exceeding the preset level is detected by the corresponding temperature sensing section 26 or the temperature sensing section 27. Then, a control element such as a relay etc. (not shown) is actuated upon receipt of the detection signal to automatically stop the motor of the fan 12. Accordingly, the refrigerant merely passes through the primary air-cooled condenser 13 and the secondary air-cooled condenser 15. Thus, if the cooling of the refrigerant by the fan 12 is interrupted, the primary air-cooled condenser 13 and the secondary air-cooled condenser 15 perform substantially no radiating function. Hence, the operation performed under air-cooling and water-cooling of the refrigerant is switched to the water-cooled operation in the water-cooled condenser 14 only, so that the heat to be exhausted from the primary air-cooled condenser 13 and the secondary air-cooled condenser 15 to the room can be controlled. Incidentally, the same effect can be exhibited by manually operating a switch (not shown) to stop the motor of the fan 12.

The load of cooling the room during the summer can thus easily be reduced. Meanwhile, during the seasons when the room temperature is relatively low, the refrigerant can effectively be cooled by the synergistic effect of the primary air-cooled condenser 13, water-cooled condenser 14 and the secondary air-cooled condenser 15, whereby to reduce the running cost of the ice making machine. Further, in the refrigerant circuit 10, since the refrigerant cooling mode is switched between the air-cooled/water-cooled operation and water-cooled operation by controlling actuation/stopping of the fan motor in the primary air-cooled condenser 13 and the secondary air-cooled condenser 15 connected serially to the water-cooled condenser, no extra piping or control valve is required, and thus the increase of cost during the ice making operation can suitably be controlled.

Incidentally, the same actions and effects can be exhibited, if the internal temperature of the room in which the ice making machine is installed is directly detected, or the temperature on the surface or inside of the casing of the compressor 11 is detected, and if the motor of the fan 12 is designed to be stopped automatically in the same manner as described above when the temperature thus detected is relatively high. Meanwhile, even in the case where an air-cooled condenser is installed on the downstream side of the water-cooled condenser 14, the similar actions and effects can be exhibited by stopping the motor of the fan 12.

Next, the temperature sensing section 27 provided on the outlet side refrigerant circuit 25 of the primary air-cooled condenser 13 sends a signal to a mechanism for stopping the ice making machine (not shown) including a control element such as a relay if the temperature detected thereby rises, for example, to 65° C. to stop the operation of the ice making machine. If the detected temperature drops, for example, to 45° C., the temperature sensing section 27 is designed to send a signal again to the stopping mechanism so as to resume operation of the ice making machine. Accordingly, if the fan motor for the primary air-cooled condenser 13 and the secondary air-cooled condenser 15 is stopped for some reasons, the temperature in the outlet side refrigerant circuit 25 of the primary air-cooled condenser 13 speedily rises to 65° C. or higher to actuate the stopping mechanism and stop the operation of the ice making machine. Incidentally, while no freezing operation is performed during the repetition of stopping and resuming the ice making operation, the stopping of the motor for driving the fan 12 can be confirmed due to actuation of a service call provided in the ice making machine, allowing speedy repair of the motor. Further, the ice making machine may also be controlled, if the fan 12 is stopped to stop the operation of the ice making machine, to give an alarm warning breakdown of the fan motor by an alarm unit such as a lamp or buzzer and not to resume the ice making operation.

Since the operation of the ice making machine is securely stopped when the fan 12 for the primary air-cooled condenser 13 and the secondary air-cooled condenser 15 is stopped as described above due to a breakdown of the fan motor and the function of cooling the refrigerant is lost, a trouble such that the refrigerant is cooled by the water-cooled condenser 14 only with the presence of breakdown not being noticed can be prevented. Namely, since decline of the running efficiency in the ice making machine can be prevented and thus the running cost can be held low, and since overheating of the motor can securely be prevented even if the fan motor is locked, burning of the system or fire accident can also be prevented, improving safety of the ice making machine and improving the commercial value thereof.

According to the refrigerant circuit of the cooling system according to this invention, since a vaporized refrigerant compressed by a compressor is passed successively through a primary air-cooled condenser, a water-cooled condenser and a secondary air-cooled condenser to be condensed thereby, not only the total cooling performance of the condensers can be improved, but also the cooling system can be downsized. Besides, the quantity of heat to be exhausted from the air-cooled condensers into the room is reduced compared with the prior art system, the working environment in the room can be improved, and further the reliability of the cooling system can be improved because of the improved operability of the system itself. In addition, since the internal temperature of the cooling water is prevented from rising greatly, troubles concomitant to discharging of hot waste water can easily be prevented, even if the water-cooled condenser is not in operation.

Further, according to the method of operating the cooling system of this invention, in spite of the air-cooled condensers and water-cooled condenser provided in the system, the heat to be exhausted from the air-cooled condensers into the room, in which the cooling system is installed, can be controlled when the temperature of the room is high, and thus the load of cooling the room can easily be reduced. On the other hand, when the room temperature is relatively low, the air-cooled condensers and the water-cooled condenser are operated effectively to improve the efficiency of cooling operation, enabling minimization of the running cost.

Meanwhile, according to the cooling system of this invention, if the fan motor for the air-cooled condensers is stopped, the mechanism for stopping the system is actuated by the temperature sensing section provided on the outlet side refrigerant circuit of the air-cooled condenser to stop the cooling system. Accordingly, an accident such that the water-cooled condenser is operated under the state where the air-cooled condensers are not functioning can be prevented, and thus the increase of running cost can securely be prevented, In addition, overheating of the motor can be prevented even if the fan motor is locked, improving the performance of maintenance and safety of the cooling system.

It should be apparent to those skilled in the art that the present invention may be embodied in many other specific forms without departing from the spirit or scope of the invention. Therefore, the present example and embodiment are to be considered as illustrative and not restrictive, and the invention is not to be limited to the details given herein, but may be modified within the scope of the appended claims.

What is claimed is:

1. A refrigerant circuit for a cooling system, comprising:

a small-capacity primary air-cooled condenser to which a vaporized refrigerant compressed in a compressor is supplied;

a water-cooled condenser to which the refrigerant fed from said primary air-cooled condenser is supplied;

a small-capacity secondary air-cooled condenser to which the refrigerant fed from said water-cooled condenser is supplied;

an expansion means to which the liquefied refrigerant fed from said secondary air-cooled condenser is supplied; and an evaporator to which the refrigerant after an abrupt pressure reduction by said expansion means is supplied; and wherein the refrigerant fed from said water-cooled condenser is supplied via an oil cooler provided in said compressor to said secondary air-cooled condenser.

2. The refrigerant circuit for a cooling system according to claim 1, wherein a self water feeding valve is connected to said water-cooled condenser, and opening and closing of said self water feeding valve is adapted to be controlled depending on the temperature or pressure of the vaporized refrigerant compressed by said compressor but before condensation by said condenser.

3. The refrigerant circuit for a cooling system according to claim 1, wherein said expansion means is an expansion valve.

4. The refrigerant circuit for a cooling system according to claim 1, wherein said expansion means is a capillary tube.

5. A refrigerant circuit for a cooling system, comprising:

a small-capacity primary air-cooled condenser to which a vaporized refrigerant compressed in a compressor is supplied;

a water-cooled condenser to which the refrigerant fed from said primary air-cooled condenser is supplied;

a small-capacity secondary air-cooled condenser to which the refrigerant fed from said water-cooled condenser is supplied;

an expansion means to which the liquefied refrigerant fed from said secondary air-cooled condenser is supplied; and an evaporator to which the refrigerant after an abrupt pressure reduction by said expansion means is supplied; and wherein the pipe line connecting said secondary air-cooled condenser via a dryer to said expansion means is contacted with the pipe line connecting said evaporator to said compressor to provide a heat exchange section, so that the refrigerant flowing from said dryer to said expansion means may be overcooled at said heat exchange section.

6. A cooling system comprising:

an air-cooled condenser to which a vaporized refrigerant compressed by a compressor is supplied;

a water-cooled condenser to which a refrigerant fed from said air-cooled condenser is supplied;

an expansion means to which a refrigerant fed from said water-cooled condenser is supplied; and an evaporator to which a refrigerant after an abrupt pressure reduction is applied thereto by said expansion means is supplied; wherein said air-cooled condenser to which said evaporated refrigerant is fed from said compressor is formed with a small-capacity primary air-cooled condenser, and a small-capacity secondary air-cooled condenser is provided between said water-cooled condenser and said expansion valve; and said refrigerant fed from said water-cooled condenser is supplied to said secondary air-cooled condenser via an oil cooler which is provided in said compressor.

7. A cooling system comprising:

an air-cooled condenser to which a vaporized refrigerant compressed by a compressor is supplied;

a water-cooled condenser to which a refrigerant fed from said air-cooled condenser is supplied;

an expansion means to which a refrigerant fed from said water-cooled condenser is supplied; and an evaporator to which a refrigerant after an abrupt pressure reduction is applied thereto by said expansion means is supplied; wherein said air-cooled condenser to which said evaporated refrigerant is fed from said compressor is formed with a small-capacity primary air-cooled condenser, and a small-capacity secondary air-cooled condenser is provided between said water-cooled condenser and said expansion valve; and a pipe line between said secondary air-cooled condenser and said expansion valve with a dryer provided in between and a pipe line between said evaporator and said compressor are disposed so as to contact to each other, thus forming a heat exchange section which overcools a refrigerant which flows from said dryer to said expansion valve.

8. A cooling system comprising:

an air-cooled condenser to which a vaporized refrigerant compressed by a compressor is supplied;

a water-cooled condenser to which a refrigerant fed from said air-cooled condenser is supplied;

an expansion means to which a refrigerant fed from said water-cooled condenser is supplied; and an evaporator to which a refrigerant after an abrupt pressure reduction is applied thereto by said expansion means is supplied; wherein said air-cooled condenser to which said evaporated refrigerant is fed from said compressor is formed with a small-capacity primary air-cooled condenser, and a small-capacity secondary air-cooled condenser is provided between said water-cooled condenser and said expansion valve;

said refrigerant fed from said water-cooled condenser is supplied to said secondary air-cooled condenser via an oil cooler which is provided in said compressor; and a pipe line between said secondary air-cooled condenser and said expansion valve with a dryer provided in between and a pipe line between said evaporator and said compressor are disposed so as to contact to each other, thus forming a heat exchange section which overcools a refrigerant which flows from said dryer to said expansion valve.

* * * * *